United States Patent [19]

Kasai

[11] Patent Number: 4,641,602

[45] Date of Patent: Feb. 10, 1987

[54] DEVELOPING APPARATUS

[75] Inventor: Toshihiro Kasai, Yokohama, Japan

[73] Assignee: Kabushiki Kaisha Toshiba, Kawasaki, Japan

[21] Appl. No.: 770,013

[22] Filed: Aug. 28, 1985

Related U.S. Application Data

[63] Continuation of Ser. No. 646,159, Aug. 31, 1984, abandoned.

[30] Foreign Application Priority Data

Aug. 31, 1983 [JP] Japan ..... 58-161254

[51] Int. Cl.[4] ..... G03G 15/08

[52] U.S. Cl. ..... 118/653

[58] Field of Search ..... 118/651, 653, 657, 658

[56] References Cited

U.S. PATENT DOCUMENTS 4,281,622 8/1981 Kudo et al. .

4,378,158 3/1983 Kanbe .

4,382,420 5/1983 Ohnuma et al. ..... 118/651

*Primary Examiner*—Bernard D. Pianalto

*Attorney, Agent, or Firm*—Cushman, Darby & Cushman

[57] ABSTRACT

Apparatus and method for applying developer to an image carrier in a copying machine so that a regulated amount of developer is applied to the image carrier during image development but is inhibited from reaching the image carrier during nondevelopment. The developer is supplied to a developer carrier roller. The amount of developer on the developer carrier roller is regulated by a regulating roller which is mounted in a position opposing the developer carrier roller. The developer carrier roller then carries the developer to a developing position opposite the image carrier. An electric field, which is reversible, is applied between the developer carrier roller and the regulating roller. During image development, the electric field is applied so that the developer is attracted to the developer carrier roller. During nondevelopment, the electric field is reversed and the developer is attracted to the regulating roller, thus inhibiting developer from reaching the image carrier.

11 Claims, 6 Drawing Figures

DEVELOPING APPARATUS

This is a continuation of application Ser. No. 646,159, filed Aug. 31, 1984, which was abandoned upon the filing hereof.

BACKGROUND OF THE INVENTION

The present invention relates to a developing apparatus for applying a developer onto a latent image formed on an image carrier to develop the latent image.

Developers used in developing apparatuses of this type include one-component developers and two-component developers. A two-component developer consists of a toner contributing to development and a carrier for properly charging this toner. However, in such a two-component developer, a mixing ratio of the toner to the carrier must be kept constant. In other words, the toner concentration must be kept constant. However, it is difficult to maintain a constant toner concentration. On the other hand, a one-component developer has an advantage in that the concentration can be easily controlled since only the toner for contributing to development is contained in the developer.

One-component developers are classified into magnetic and nonmagnetic developers. Magnetic developers contain magnetic materials in the nonmagnetic developer particles. When such a magnetic developer is used in a conventional apparatus, a magnet is arranged on the inside of a developer carrier for carrying the developer into the developing position and generating a magnetic field for supporting the developer. The following problems occur when the magnetic developer is used.

(1) The developer carrier becomes complicated, expensive and large since the magnet must be supported by the developer carrier.

(2) A magnetic developer containing magnetic particles is more expensive than a nonmagnetic developer.

(3) Since a magnetic developer contains magnetic particles which do not contribute to development, color reproducibility is not so good. As a result, it is difficult to perform color development using a magnetic developer.

In the case of using either developer, when developer is applied to the developing position opposite to the image carrier, excessive developer which is not subjected to developing can be applied because there is no regulation to the developer. For this reason, when the developing image is transferred to a sheet, the excessive developer is also transferred to the sheet, thereby contaminating the transferred image. In addition to this disadvantage, the excessive developer leaks and drips from the developing apparatus.

SUMMARY OF THE INVENTION

It is an object of the present invention to provide a developing apparatus and method wherein when a developer support feeds a developer to a developing position opposite to an image carrier, feeding of excessive developer which is not subjected to developing can be prevented.

According to an aspect of the present invention, there is provided a developing apparatus for developing an electrostatic latent image by electrostatically applying a charged developer to the electrostatic latent image formed on a surface of an image carrier at a developing position opposing the image carrier. Developer is supplied to a developer carrier. The amount of developer on the developer carrier is regulated by a regulating member which is placed near the developer carrier. The developer carrier then carries the developer to the developing position. An electric field, which is changeable in direction, is applied between the developer carrier and the regulating member so that developer is attracted to the developer carrier during image development but attracted to the regulating member during nondevelopment. Thus, a regulated amount of developer is applied to the image carrier during image development while developer is inhibited from reaching the image carrier during nondevelopment.

DETAILED DESCRIPTION OF THE PREFERRED EMBODIMENTS

Developing apparatuses according to preferred embodiments of the present invention will be described with reference to FIGS. 1 to 6.

Figure 1:
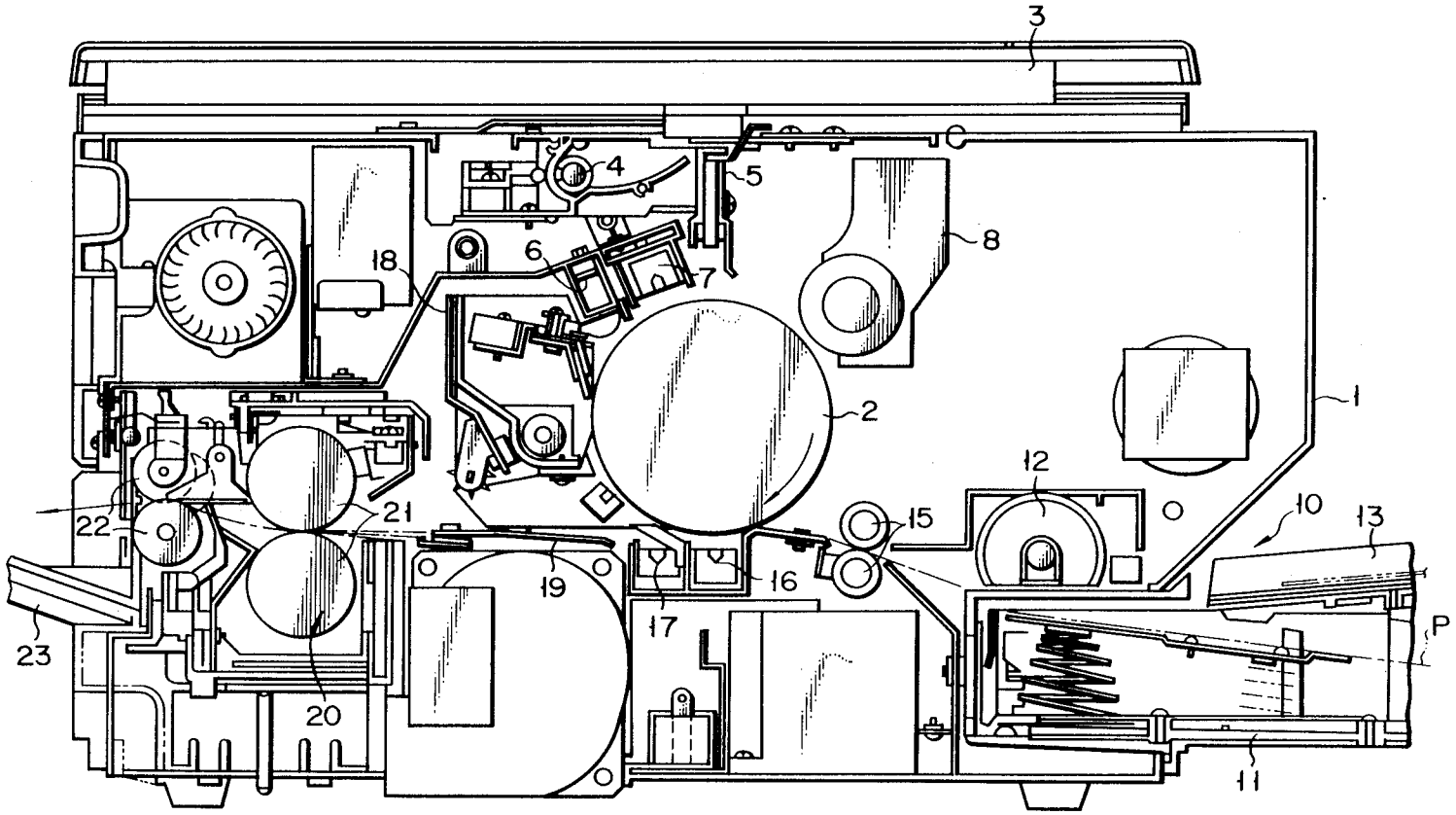
FIG. 1 is a sectional view schematically showing a copying machine using a developing apparatus according to an embodiment of the present invention.

An image forming apparatus such as a copying machine to which the developing apparatus according to the present invention may be applied will be described. FIG. 1 is a schematic sectional view of the copying machine. Referring to FIG. 1, reference numeral 1 denotes a copying machine housing. A photosensitive drum 2 having a photosensitive film such as a selenium film thereon is rotatably arranged at substantially the center of the housing 1. An electrostatic latent image is formed on the surface of the photosensitive drum 2 as an image carrier. A lamp 4 and a converging optical transmission member 5 optically scan a document placed on a reciprocally driven document table 3, focus a document image on a surface portion of the photosensitive drum 2 and form a latent image on the surface portion thereof. Arranged around the photosensitive drum 2 are a discharge lamp 6 for discharging the surface of the photosensitive drum 2 before the document image is focused thereon, a charger 7 for uniformly charging the surface of the photosensitive drum 2 after the surface of the photosensitive drum 2 is uniformly discharged, and a developing apparatus 8 according to the present invention for selectively applying the developer to the latent image formed on the surface of the photosensitive drum and for visualizing the latent image. A visible image is formed by the developing apparatus 8 on the photosensitive drum 2.

A paper feeding section 10 is arranged at one side (right side in FIG. 1) of the housing 1. The paper feeding section 10 comprises a paper cassette 11 detachably mounted at one side of the copying machine, paper feeding rollers 12 brought into rolling contact with the uppermost sheet P so as to feed this sheet P to the inside of the housing 1, and a manual feeding guide 13 for manually guiding a sheet. The sheet fed from the paper feeding section 10 is registered by register rollers 15 and is fed to a transfer portion of the photosensitive drum 2 while the sheet is brought into slidable contact with the transfer portion.

A transfer charger 16 for transferring the visible or toner image onto the sheet P and a separation charger 17 for separating the transferred sheet from the photosensitive drum 2, are arranged around the photosensitive drum 2. The transfer portion described above is defined between the photosensitive drum 2 and the transfer charger 16. The sheet having the toner image (visible image) thereon is guided by a conveyor belt 19 to a fixing unit 20. The developer on the sheet is fixed by pressure and heat by a pair of heat rollers 21 constituting the fixing unit 20. The sheet having the fixed image is discharged by a pair of discharge rollers 22 onto a tray 23. The residual toner remaining on the surface of the photosensitive drum 2 after the transfer operation can be removed by a cleaning unit 18.

Figure 2:
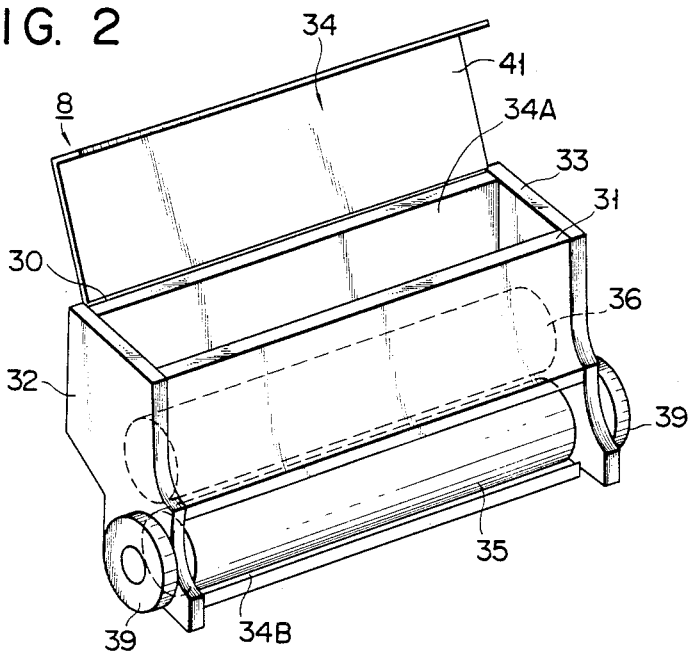
FIG. 2 is a perspective view schematically showing the developing apparatus shown in FIG. 1.

The developing apparatus 8 according to the embodiment of the present invention will be described with reference to FIGS. 2 and 3. It should be noted that a nonmagenetic developer T (shown in FIG. 3) is used as a developer. The developing apparatus 8 has a housing 34 defined by back and front frames 30 and 31, arranged to be separated from each other, and side frames 32 and 33, separated from each other at the sides of the back and front frames 30 and 31. The housing 34 has an opening 34A at its upper end portion for supplying the developer T therein. A cap 41 is provided at the opening 34A to be freely opened/closed when the developer T is supplied through the opening 34A. A front opening 34B is formed below the front frame 31. The front opening 34B defines a developing position M (shown in FIG. 3) opposite to the photosensitive drum 2 and is used for feeding the developer T stored in the housing 34 to the photosensitive drum 2. In the front opening 34B, a developing roller (developer carrier) 35 is rotatably supported by the side frames 32 and 33. The nonmagnetic developer T, which is charged by friction in the housing 34, is carried on a surface of the developing roller 35 and is fed to the development position M thereby. The developing roller 35 is made of a metal such as aluminum or stainless steel, or a metal coated with an insulating material.

In the housing 34, a regulating roller 36 as a regulating member is rotatably supported above and opposite to the developing roller 35 by the side frames 32 and 33. The regulating roller 36 is rotated in synchronism with the developing roller 35 so as to regulate an amount of the developer T fed by the developing roller 35. The regulating roller 36 is formed of a metal such as aluminum or stainless steel, or a metal coated with an insulating material. It should be noted that a gap l (FIG. 3) between the regulating roller 36 and the developing roller 35 is determined by the diameter of the developer particles and the thickness of a developer layer applied to the developing roller 35. For example, when the diameter of the developer particles is about 10 μm or more, the gap l is preferably set to be about 20 μm to 100 μm.

Figure 3:
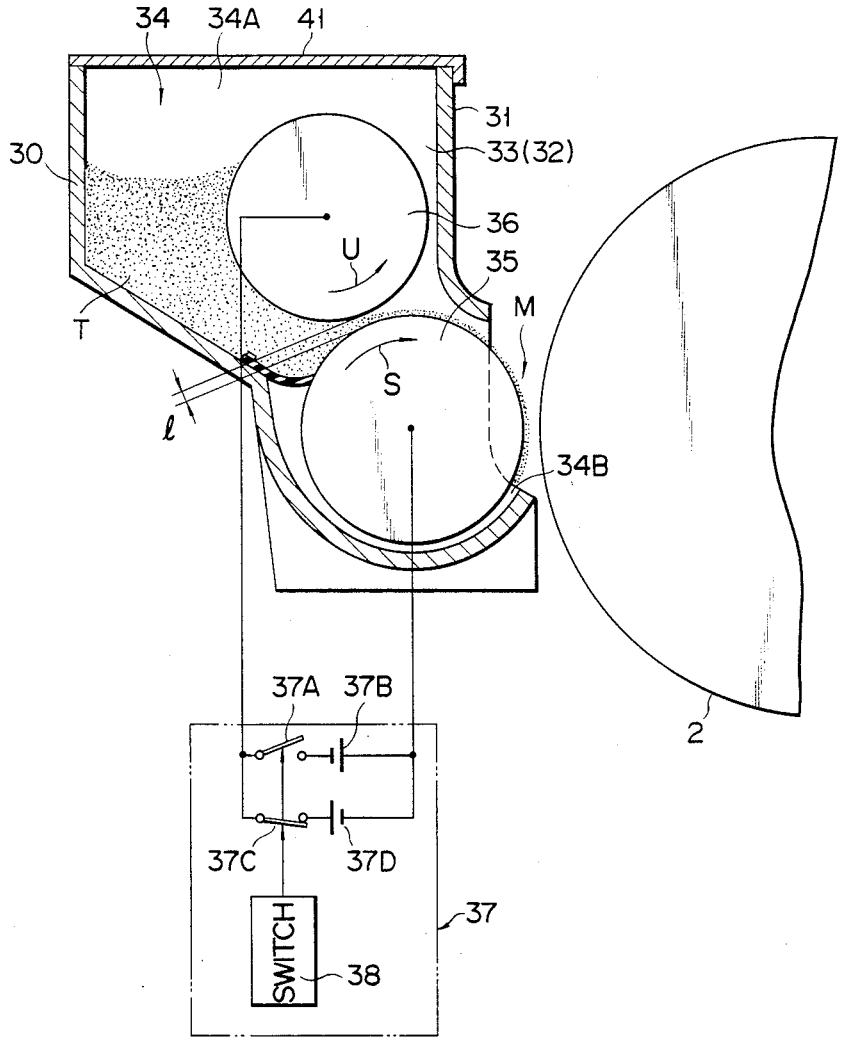
FIG. 3 is a sectional view schematically showing the developing apparatus shown in FIG. 2.

As shown in FIG. 3, an applying mechanism 37 is coupled to the developing roller 35 and the regulating roller 36. The applying mechanism 37 serves as an electric-field forming means for forming an electric field between the rollers 35 and 36 so as to electrostatically regulate the developer fed to the developing position M.

In the applying mechanism 37, a first power supply 37B and a second power supply 37D, whose polarity is reversed with respect to the first power supply 37B, are arranged in parallel. In this embodiment, the developing roller 35 is coupled to a positive electrode of the first power supply 37B and a negative electrode of the second power supply 37D. On the other hand, the regulating roller 36 is coupled to a negative electrode of the first power supply 37B and a positive electrode of the second power supply 37D through first and second switches 37A and 37C, respectively. A switch driving means 38 is coupled to the first and second switches 37A and 37C. The switch driving means 38 can perform ON/OFF switching with respect to the first and second power sources 37B and 37D through the switches 37A and 37C, respectively, so that one of the these power supplies 37B and 37D is in the "ON" state, while the other is in the "OFF" state. The switch driving means 38 selectively applies voltage to the rollers 35 or 36 for selectively applying the developer to the surface of the developing roller 35 or the regulating roller 36. This forms a developer layer on the developing roller 35 in the developing mode and prevents the developer layer from being formed on the developing roller 35 in the nondeveloping mode. For example, when the developer stored in the housing 34 has a positive frictional charged polarity, the second switch 37C is turned on in the developing mode and the first switch 37A is turned on in the nondeveloping mode. Note that the switch driving means 38 is controlled by a control signal supplied from a control unit (not shown). When the document table 3 shown in FIG. 1 is moved in a forward direction, the developing mode is determined and the second switch 37C is turned on. On the other hand, when the document table 3 is moved in a reverse direction, the non-developing mode is determined and the first switch 37A is turned on. The developing apparatus 8 is arranged at the development position M at which the developer is not in contact with the photosensitive drum 2. This noncontact relationship depends upon the diameter of the developer particles and the thickness of the developer layer coated by the developing roller 35. In order to obtain a good image formed due to precise application of the developer, a gap (gap of the development position M) between the developing roller 35 and the photosensitive drum 2 needs to be as narrow as possible. Therefore, the developer layer coated on the developing roller 35 is preferably a thin layer. Furthermore, since the gap between the developing roller 35 and the photosensitive drum 2 is determined by the relationship between the diameter range of the developer particles subjected to development and resolution, the gap therebetween at the developing position M is preferably set to fall within the range between 50 μm to 400 μm. In order to maintain this gap, a gap-regulating roller 39 (FIG. 2) is coaxially provided with the developing roller 35. The gap-regulating roller 39 abuts against the surface of the photosensitive drum 2 or a receiving roller (not shown) which is coaxially provided with the photosensitive drum 2, thereby maintaining a constant gap between the photosensitive drum 2 and the developing roller 35. In the developing mode, a power supply (not shown) can be provided to generate a potential difference between the developing roller 35 and the photosensitive drum 2, thereby generating an electric field therebetween. In this case, this power supply allows for an easy application of the developing agent on the developing roller 35 to the surface of the photosensitive drum 2 or regulates application of the developer to prevent fog from forming on the image, due to the electric field between the developing roller 35 and the photosensitive drum 2. The power supply is not always needed. This is because the developer charged by friction on the developing roller 35 can be sufficiently applied to the surface of the photosensitive drum 2 simply by electrostatic attraction due to a latent electric charge on the surface of the photosensitive drum 2.

The operation and effect of the developing apparatus 8 described above will be described hereafter. The non-magnetic developer T is stored in the housing 34 of the developing apparatus 8. The developing roller 35 and the regulating roller 36 are rotated in directions indicated by arrows S and U in FIG. 3, respectively. The developer T is, for example, positively charged by friction between individual particles or between the rollers 35 and 36, and is rushed between the rollers 35 and 36. When the thus rushed developer T is adjacent to the position where the rollers 35 and 36 are closest (the position at which the gap therebetween becomes l in FIG. 3), it is pressed to form a thin layer. The thickness of the thus formed thin layer is finally regulated by the gap l between the developing roller 35 and the regulating roller 36. Therefore, a thin layer of the developer T having a desired thickness can be obtained at the position where the developing roller 35 and the regulating roller 36 are closest.

In the developing mode, when the positively charged developer T is used, the switch driving means 38 is operated to turn on the switch 37C, thereby giving negative and positive polarities to the developing roller 35 and the regulating roller 36, respectively. Therefore, when the positive developer T is fed between the developing roller 35 and the regulating roller 36, it is electrostatically attracted onto the developing roller 35 and is fed to the developing position M by the rotation thereof. In this manner, when the developer T is fed to the developing position M, a thickness thereof is regulated by the gap l at the position where the developing roller 35 and the regulating roller 36 are closest, thereby obtaining a uniform thickness. The developer T is deposited onto the surface of the photosensitive drum 2 by an electrostatic attraction due to an electric field formed between the developing roller 35 and the photosensitive drum 2, and by the attraction of a latent image electrical charge on the surface of the photosensitive drum 2, thereby obtaining the developed image. Since the developer T is uniformly coated on the developing roller 35, the developer T can be selectively applied on the photosensitive drum 2 to be uniform in thickness at each portion of an electrostatic latent image formed thereon, thus obtaining an excellent visible image (developing image). For the same reason as described above, if the gap between the developing roller 35 and the photosensitive drum 2 is set to be slightly larger than the thickness of the developer T coated on the developing roller 35, the developer T can be sufficiently applied to the photosensitive drum 2 so as to obtain a satisfactory visible image.

According to the embodiment, demands for minimizing the gap between the developing roller 35 and the photosensitive drum 2 can be sufficiently satisfied. Furthermore, for the same reason, even when a one-component developer is used, noncontact development (i.e., an image carrier and a coated developer layer on a developer carrier are separated, and the developer is applied to an electrostatic latent image formed on the image carrier, thereby performing development) can be sufficiently performed. Therefore, this noncontact development can be adopted for the overlapping development neccesary for color development. Furthermore, since the development is a noncontact one, damage due to the contact of the developing roller 35 with the photosensitive drum 2 (image carrier) and eventual deterioration thereof can be completely prevented.

On the other hand, in the non-developing mode, the switch 37A is turned on by operating the switch driving means 38, thereby giving positive and negative polarities to the developing roller 35 and the regulating roller 36, respectively, with respect to the positively charged developer T. In this case, the developer passes through the gap between the developing roller 35 and the regulating roller 36 and is fed so as to be electrostatically attracted by the regulating roller 36. Therefore, the developer which is not subjected to the development is not applied to the developing roller 35, but to the regulating roller 36. Since the regulating roller 36 is rotated in the direction indicated by the arrow U, the developer applied thereon is circulated in the housing 34. According to this embodiment, the developer which is not subjected to development cannot be fed to the development position M, but is simply circulated, thus preventing leakage of the developer from the front opening 34B of the housing 34, or contamination of the photosensitive drum 2.

Figure 4:
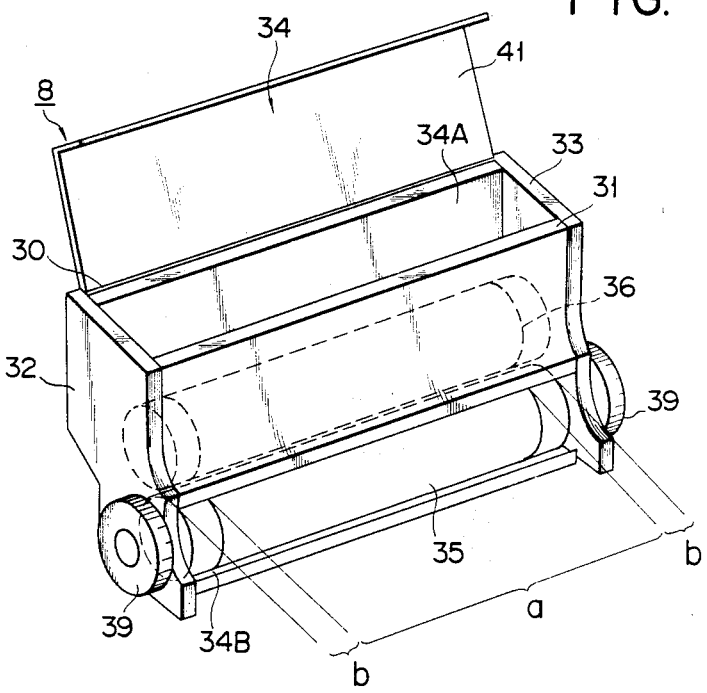
FIG. 4 is a perspective view schematically showing a developing apparatus according to another embodiment of the present invention.
Figure 5:
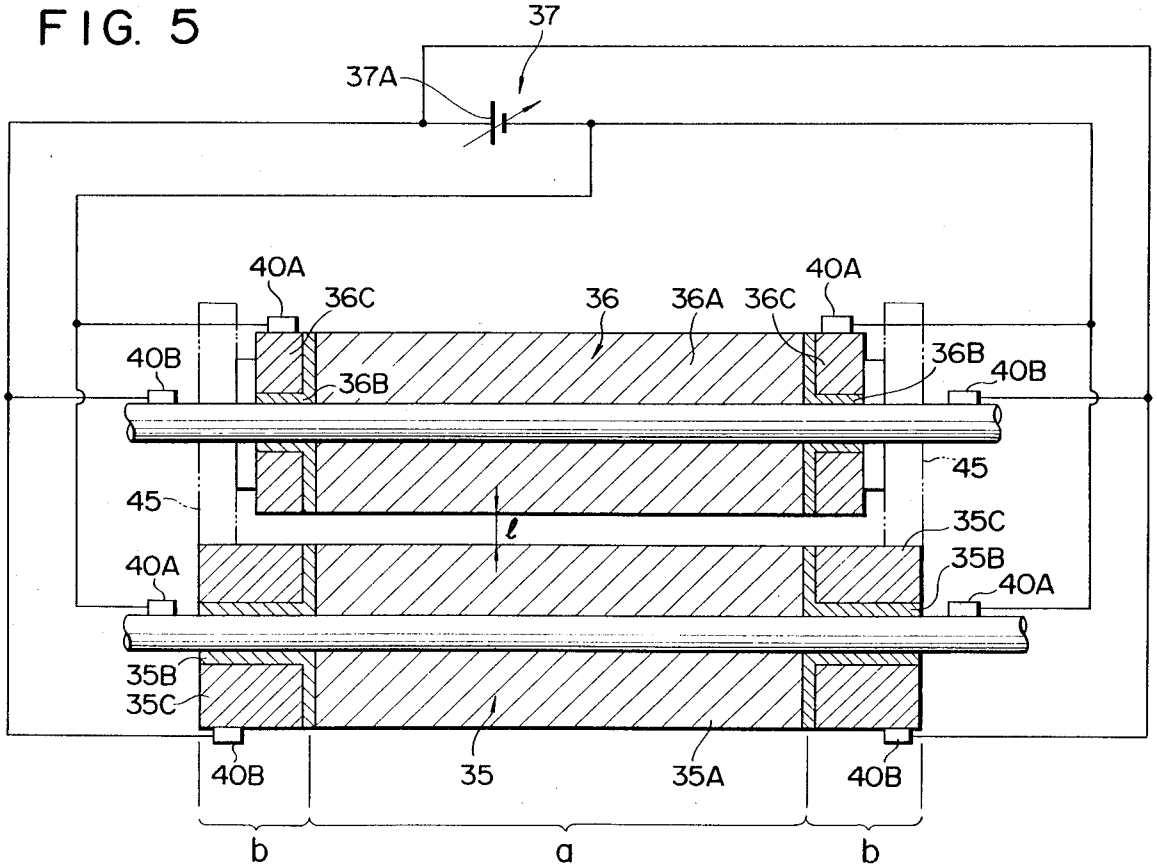
FIG. 5 is a sectional view schematically showing the construction of a main part of the developing apparatus shown in FIG. 4.
Figure 6:
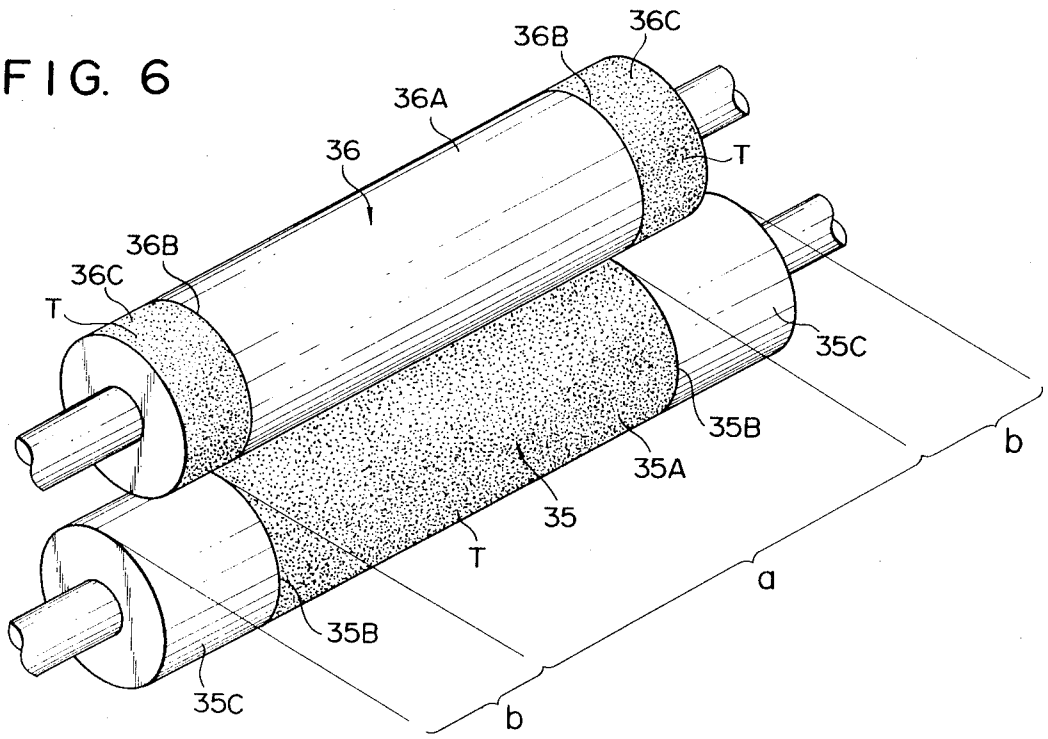
FIG. 6 is a view for explaining the operation of the developing apparatus shown in FIG. 4.

Another embodiment of the present invention will now be described with reference to FIGS. 4 to 6. It should be noted that the same reference numerals as in the embodiment described above denote the same parts in this embodiment and a detailed description thereof is omitted. In this embodiment, non-developing regions b, on which the developer is not applied, are provided at two side-end portions of a developing roller 35 along its longitudinal axial direction. In other words, a region of the developing roller 35 corresponding to an effective width of a circumferential surface region of a photosensitive drum 2, on which an electrostatic latent image is to be substantially formed, will be referred to as developing region a, and regions formed at the two side-end portions of the developing roller 35 corresponding to two end portions of the photosensitive drum 2, on which no latent image is substantially formed, will be referred to as nondeveloping regions b.

A structure of a main part of a developing apparatus 8 according to this embodiment will now be described with reference to FIG. 5.

In the developing roller 35, insulators 35B are fitted to the two end portions of a roller 35. Region 35A thus constitutes the development region a. Sleeves 35C which constitute the nondeveloping regions b are fitted around the insulators 35B. In the regulating roller 36, insulators 36B are fitted to the two end portions of a roller 36. Thus, region 36A corresponds to the developing region a, in the same manner as described above. At the two insulators 36B, sleeves 36C which correspond to the nondevelopment region b are fitted. An applying mechanism 37 generates a voltage between the developing roller 35 and the regulating roller 36 so as to form a developer image having a predetermined thickness only on the developing region a of the developing roller 35. When a positively charged developer is used, the roller 35A and the sleeves 36C are connected to a negative side of an applying unit 37A through slidable electrodes 40A, respectively. On the other hand, the sleeves 35C and the roller 36A are respectively connected to a positive side of the applying unit 37A through slidable electrodes 40B. In FIG. 5, reference numeral 45 denotes a gap regulating roller for regulating a gap l between the developing roller 35 and the regulating roller 36. The gap regulating roller 45 is coaxially and rotatably provided with the regulating roller 36. A circumferential surface of the gap regulating roller 45 abuts against the surface of the developing roller 35, thereby maintaining a distance between centers of the rollers 35 and 36 at a predetermined value. However, if the developing roller 35 and the regulating roller 36 are satisfactorily supported between the side frames 32 and 33, the gap regulating roller 45 is not necessary.

The operation and effect of the developing apparatus of this embodiment will now be described. When the applying mechanism 37 is operated, a negative polarity is provided to the roller 35A of the developing roller 35 and the sleeves 36C of the regulating roller 36, and a positive polarity is provided to the sleeves 35C and the roller 36A. For this reason, when, for example, a positively charged developer T is rushed between the developing roller 35 and the regulating roller 36, the developer T is electrostatically attracted onto the development region a of the developing roller 35, as shown in FIG. 6. On the other hand, in the nondeveloping region b, the developer T is electrostatically attracted onto the sleeves 36C of the regulating roller 36. Therefore, excessive developer which is not subjected to development is applied to the sleeves 36C of the regulating roller 36 and is circulated in the housing 34 by the rotation of the roller 36. The excessive developer T positioned at the nondeveloping region b cannot leak from the front opening 34B of the housing 34 and undesirable contamination of the photosensitive drum 2 can be prevented. According to this embodiment, the developer which is not subjected to development cannot be fed to the developing position, but is simply circulated, thereby preventing leakage of the developer from the front opening 34B of the housing 34 and undesirable contamination of the photosensitive drum 2 in the nondeveloping mode. In addition, the developer applied to the developing roller 35 and fed thereby is regulated by the gap l between the developing roller 35 and the regulating roller 36, thus obtaining a thin layer of a uniform thickness.

The present invention is not limited to the above embodiments and various variations and modifications can be made within the spirit and scope of the present invention.

For example, in the above embodiments, a developer positively charged by friction is used, but one negatively charged by friction can also be used to obtain the same effect. However, in this case, inverted polarities to those of the above embodiments are applied to the developing roller and the regulating roller, respectively.

In the former embodiment, the switches 37A and 37C are used as the applying mechanism. However, the present invention is not limited to this construction. For example, a construction in which one switching member is provided, this switching member being capable of switching first and second power supplies, can be provided. The developer carrier and the regulating developer carrier can be constructed not only of a metal drum such as aluminum or stainless steel, but also of a metal plate or belt. Furthermore, the surface of such a metal plate or belt can be coated with Alumite or can be chromium-plated. More particularly, if such surface treatment is performed, wear on the developer carrier surface can be prevented, resulting in prolonged and satisfactory image stability and a long life for the developer carrier. On the other hand, an electrostatic latent image formed by the developing apparatus according to the above embodiments need not always be formed by the copying machine as shown in FIG. 1, but can be any pattern of charged electric particles formed by, e.g., a cathode-ray tube, laser light, cat-whisker, or light-emitting diode.

What is claimed is:

1. A developing apparatus for developing a latent image by applying a developer to the latent image formed on a surface of an image carrier at a developing position opposing said image carrier, comprising:
   - a developer carrier for carrying said developer to said developing position;
   - developer supplying means for supplying said developer to said developer carrier;
   - regulating means, provided to oppose said developer carrier, for regulating said developer to be fed by said developer carrier; and
   - means for charging said regulating means to a first polarity and said developer carrier to a second polarity during a time of developing to cause said developer to be attracted to said developer carrier, and for charging said regulating means to said second polarity and said developer carrier to said first polarity during a time of nondevelopment to cause said developer to be repelled from said developer carrier.

2. An apparatus according to claim 1, wherein said developer carrier comprises a developing roller having a cylindrical shape, and said developer carried thereon is fed from said developer supplying means to said developing position by rotating said developing roller about an axis thereof.

3. An apparatus according to claim 2, wherein said developer carrier includes a gap regulating roller so as to maintain a predetermined gap between said developer carrier and said image carrier.

4. An apparatus according to claim 3, wherein said gap regulating roller is coaxially provided with said developing roller and is rotated together therewith.

5. An apparatus according to claim 2, wherein said regulating means comprises a regulating roller which has a cylindrical shape and is rotatable about an axis thereof.

6. An apparatus according to claim 5, wherein a predetermined gap is formed between said regulating roller and said developing roller through which said developer is rushed, thereby regulating a thickness of a layer of said developer supported by said developing roller.

7. An apparatus according to claim 6, wherein said predetermined gap between said regulating roller and said developing roller is set to fall within the range between 20 $\mu$m to 100 $\mu$m.

8. An apparatus according to claim 1, wherein said charging means comprises a power source and a switching mechanism which electrically disconnects said power source from said regulating means when said power source is electrically connected to said developer carrier, and electrically connects said power source to said regulating means when said power source is electrically disconnected from said developer carrier.

9. An apparatus according to claim 8, wherein said power source includes two power sources arranged in parallel, and wherein said switching mechanism includes an interlocking switch for electrically and switchably coupling one of said power sources to said developer carrier and coupling the other of said power sources to said regulating means, respectively.

10. An apparatus according to claim 9, wherein said developer carrier includes a developing region which carries said developer and is formed at a central portion of said developer carrier along an axial direction thereof, and nondeveloping regions which do not carry said developer which are formed at two end portions of said developer carrier.

11. An apparatus according to claim 10, wherein said developer has a polarity, and wherein insulating materials are sandwiched between said developing region and said nondeveloping region, and further including:

means for applying a voltage having the same polarity as that of said developer to said nondeveloping region; and, means for applying a voltage having a different polarity as that of said developer to a portion of said regulating means corresponding to said nondeveloping regions of said developer carrier, thereby eliminating the developer from the portion of the developer carrier corresponding to said nondeveloping regions.

* * * * *